United States Patent [19]

Takenaka et al.

[11] 4,366,415

[45] Dec. 28, 1982

[54] PICTURE TUBE WITH AN ELECTRON GUN HAVING AN IMPROVED POTENTIAL SUPPLYING MEANS

[75] Inventors: Shigeo Takenaka; Eiji Kamohara, both of Fukaya, Japan

[73] Assignee: Tokyo Shibaura Denki Kabushiki Kaisha, Kawasaki, Japan

[21] Appl. No.: 140,953

[22] Filed: May 30, 1980

[30] Foreign Application Priority Data

May 30, 1979 [JP] Japan ..... 54/66077

[51] Int. Cl.[3] ..... H01J 29/56; H01J 29/96

[52] U.S. Cl. ..... 313/457; 313/417

[58] Field of Search ..... 313/414, 417, 457, 477, 313/482, 449, 450

[56] References Cited

U.S. PATENT DOCUMENTS

| | | | |
|---|---|---|---|
| 3,932,786 | 1/1976 | Campbell | 313/414 |
| 4,143,298 | 3/1979 | Bing et al. | 313/450 |
| 4,288,719 | 9/1981 | Hernquist | 313/457 |

*Primary Examiner*—Eli Lieberman

*Attorney, Agent, or Firm*—Schuyler, Banner, Birch, McKie & Beckett

[57] ABSTRACT

The invention is directed to a picture tube comprising an electron gun installed within an evacuated envelope which receives various potentials supplied from a potential source. The electron gun comprises a cathode for generating an electron beam and a plurality of successively arranged electrodes for focusing and accelerating the electron beam. One or more supporting rod secures the electrodes. Each of the supporting rods comprises an insulator portion and a glass resistance portion. The glass resistance portion acts as a solid bulk resistor and secures in direct connection with at least one electrode of the electron gun. Consequently, potentials from the potential source are applied to certain electrodes through the glass resistance body. In a further embodiment the entire supporting rod consists of a homogeneous glass resistance body.

7 Claims, 18 Drawing Figures

PICTURE TUBE WITH AN ELECTRON GUN HAVING AN IMPROVED POTENTIAL SUPPLYING MEANS

BACKGROUND OF THE INVENTION

This invention relates to picture tubes more particularly to electron guns having improved potential supplying means.

In general, color picture tubes are provided with an electron gun for generating multi-electron beams within an envelope comprising a panel, a funnel and a neck portion having stem pins. The electron beams are focused on a target after passing through a main electrostatic focusing lens, formed by an electrostatic field between grid electrodes which are contained within the electron gun. The focusing characteristics of this lens is determined by the distance and voltage difference between the grid electrodes, and their respective aperture diameter.

The performance of the electron gun can also be improved by utilizing a long focal length lens which will reduce magnification and spherical aberration. In forming such a long focal length lens, three methods are generally used. The first method requires the controlling of the voltage difference between grid electrodes. With this method, however, the range of voltage control is limited by discharge that occurs between stem pins. Another method consists of using large diameter grid apertures; the use of this method, however, is restricted by the desirability of having narrow neck type picture tubes. This problem is compounded with the use of the larger multi-beam electron guns which further limits the available space within the neck portion. The final method consists of separating the distance between the grid electrodes. As a result, however, the lenses produced are easily affected by undesirable electric fields generated from charges on the inner wall of the neck and supporting rods of the electron gun.

In recent years complex lens gun systems have been developed to overcome the restrictions mentioned above. Such complex lens gun systems can be used to obtain a long focal lens by means of combining a plurality of lenses. For example, the well known bi-potenial lens, the uni-potential lens and the tri-potential lens can be combined with each other. The combination of lenses, however, complicates the electron gun structure and requires various different potentials being applied to the grids. Such potentials, furthermore, must be increased for effective operation. Consequently, as the number of stem pins necessary to supply the various potentials is increased, the distances between the pins will be reduced and the voltage differences therebetween will increase. As a result, undesirable discharge will easily occur between the pins.

These disadvantages can be overcomed by installing a potentiometer within the envelope. Since a potentiometer can supply a plurality of potentials to the grids by dividing the high anode voltage, it will be unnecessary to increase the number of stem pins for applying various different potentials to the grid.

It has been proposed that a plurality of discrete resistors can be arranged in series within the neck portion of the electron gun to function as a potentiometer. With this arrangement, however, there is minimal space between the inner wall of the neck portion and the electron gun to accommodate the resistors. Consequently, a larger diameter neck portion or a smaller electron gun must be utilized to accommodate these resistors. In either case, certain disadvantages will occur. That is, a larger neck will require an increase in the amount of deflecting power, while a smaller electron gun will reduce the quality of the electron beam. Moreover, utilizing smaller resistors within this limited space would necessarily have a reduced power rating. Such results, consequently, would be impractical when used with the high anode voltage.

Another method is directed to forming a potentiometer by applying a thin film resistor by evaporation to the supporting rod of the electron gun. As with the use of smaller resistors mentioned above, a thin film potentiometer would necessarily be impractical due to its low power rating. The application of approximately 25 KV of anode voltage would destroy the thin film resistance layer.

SUMMARY OF THE INVENTION

An object of this invention is to overcome the disadvantages of the conventional picture tube device including restrictions of supplying a variety of high potentials to the electron gun of the tube.

A further object of this invention is to provide a picture tube whereby potentials are applied to an electron gun through its supporting rod.

In accordance with the invention, there is provided a picture tube device comprising an electron gun installed within an evacuated envelope which receives various potentials supplied from a potential source. The electron gun comprises a cathode for generating an electron beam and a plurality of successively arranged electrodes for focusing and accelerating the electron beam. One or more supporting rod secures the electrodes. Each of the supporting rods comprises an insulator portion and a glass resistance body portion. The glass resistance portion acts as a solid bulk resistor and secures in direct connection with at least one electrode of the electron gun. Consequently, potentials from the potential source are applied to certain electrodes through the glass resistance body. In a further embodiment, the entire supporting rod consists of a homegenous glass resistance body.

DETAILED DESCRIPTION OF PREFERRED EMBODIMENT

Figure 1:
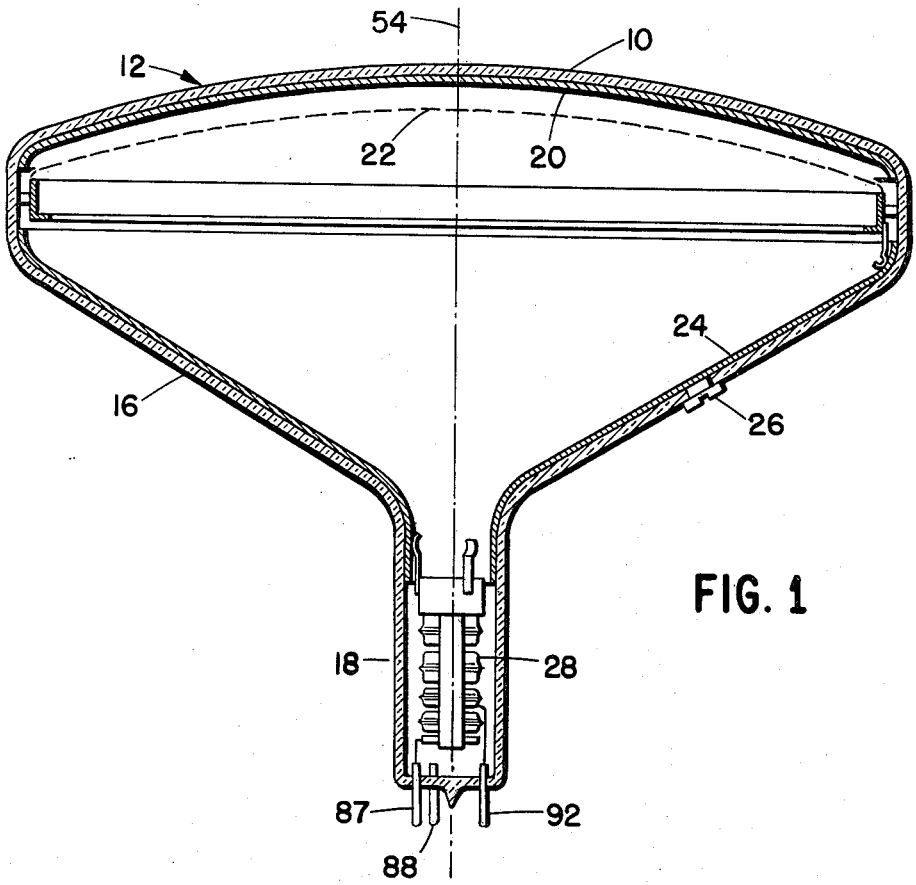
FIG. 1 is a longitudinally sectional view of a color picture tube embodying an electron gun according to this invention.

Referring now to FIGS. 1–4, a color picture tube of one embodiment of this invention is illustrated. Color picture tube 10 is provided with an evacuated envelope 12 comprising panel 14, funnel portion 16 and neck portion 18. Panel 14 is provided with a phosphor screen 20 on the inner wall and a color selection electrode 22 (i.e., a shadow mask) near the phosphor screen 20. Funnel portion 16 extends from panel 14 and includes, on its inner wall, a carbon layer 24 having an anode terminal 26; the anode terminal extends through the wall of funnel portion 16.

An electron gun 28 is installed within the neck portion 18. Neck portion 18 has a stem 30 comprising a plurality of lead stem pins 87, 88, 92 hermetically extending outside envelope 12 for supplying voltage to the electron gun. Electron gun 28 comprises three cathodes 34, 36, and 38, and the following electrodes: a first grid 40, a second grid 42, a third grid 44, a fourth grid 46, a fifth grid 48, a sixth grid 50 and a shield cup electrode 52. The electrodes are arranged successively along an axis 54 of envelope 12 by means of a pair of supporting rods 56 and 58. The electrodes are directly embedded and rigidly secured in the supporting rods.

Cathodes 34, 36 and 38, first grid 40 and second grid 42 comprise a triode section, while electrodes 44, 46, 48 and 50 comprise a focusing section. Cathodes 34, 36 and 38 generate respective electron beams along three paths 60, 62 and 64 arranged in a line. First grid 40 and the second grid 42 are plate-like electrodes, having three apertures, each being aligned with paths 60, 62 and 64, respectively.

Figure 3:
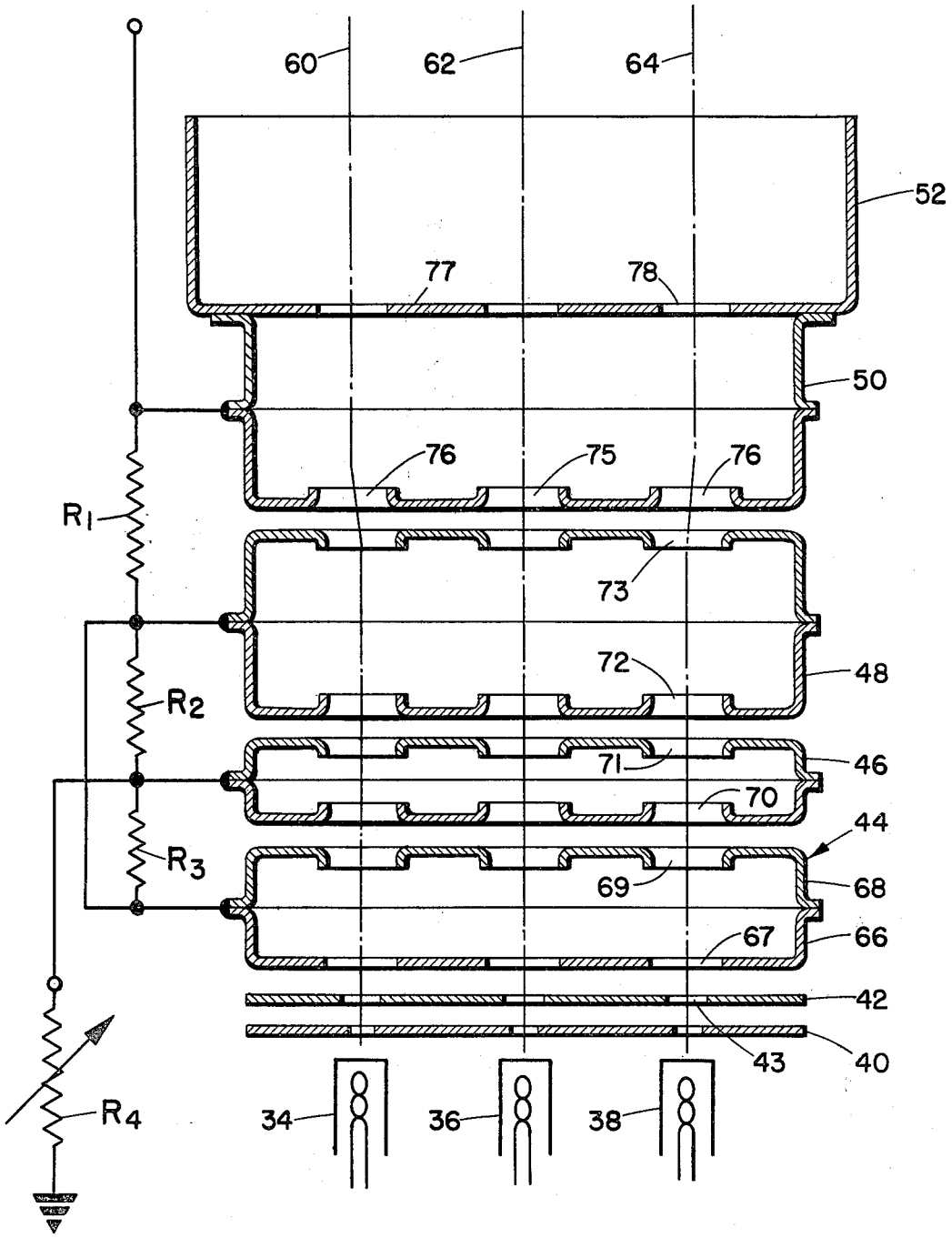
FIG. 3 is a schematic view of the electron gun of this invention shown in FIG. 2.

As shown in FIG. 3, the third grid to the sixth grid 44, 46, 48 and 50 each comprise two cup-shaped member facing each other. Each cup-shaped member has three apertures which are aligned with respective paths of beams, 60, 62 and 64. Cup-shaped member 66, of the third grid 44 is provided with a set of apertures 67 having a larger diameter than apertures 43 of the second grid 42 which faces member 66. Further, aperture 43 is larger than aperture 41 of first grid electrode 40. Cup-shaped member 68 of the third grid 44 is provided with apertures 69 having a larger diameter than apertures 67. The fourth and the fifth grids 46 and 48 also have a set of apertures 70, 71 and 72, 73, respectively. The portion of sixth grid electrode 50, facing fifth grid 48, contains a center aperture 75 aligned with path 62, while both side apertures 76 are offset slightly outwardly from path 60 and 64, respectively. Each of these offsets form an asymmetric field between apertures 73 and 76 along paths 60 and 64, respectively, for converging the three electron beams at a point on screen 20. Shield cup 52 extends toward screen 20 and has a bottom 77 containing three apertures 78.

Figure 2:
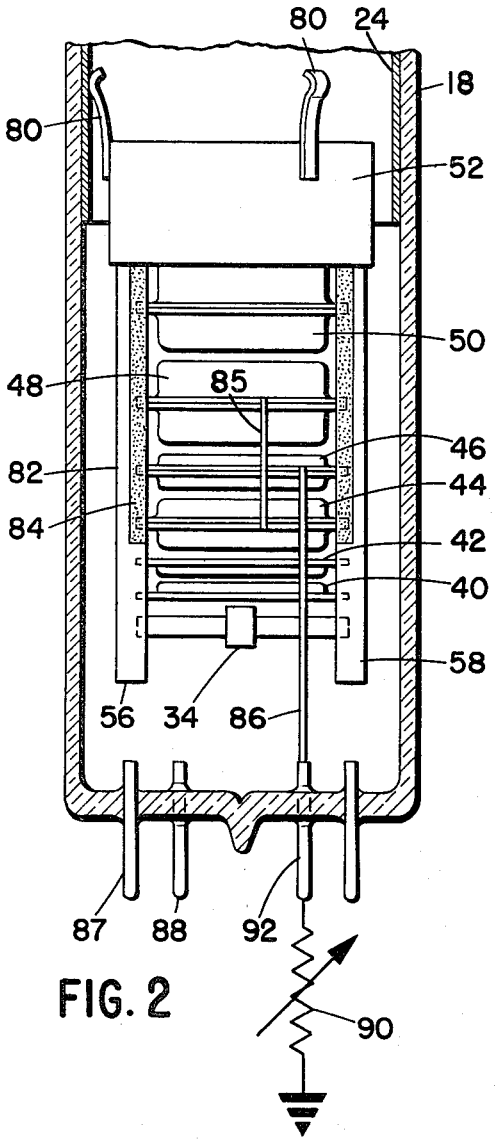
FIG. 2 is a side view of an electron gun according to this invention.

As shown in FIG. 2, three metal spring members 80 are attached to the shield cup 52 in order to axially secure the electron gun on axis 54 of the envelope and to electrically connect it to anode 24. Supporting rods 56 and 58, each comprises a complex member having an insulating glass portion 82 and a resistance (e.g., semiconductance) glass portion 84. For example, the resistance glass body could comprise a transition metal, such as $Fe_2O_3$, $MnO_2$, $V_2O_5$, $Cu_2O$ and mixtures thereof, in combination with approximately 96% by weight of silica glass. It is desired that the inherent resistant value of the resistance glass should approximately equal 10 MΩ. mm to about 1000 MΩ. mm. As shown in FIG. 2, resistance glass portion 84 directly contacts the third through the sixth grid electrodes 44, 46, 48 and 50. Third grid 44 is interconnected to the fifth grid 48 through an inner lead 85 without the need for connection to a stem pin. First grid 40 and the second grid 42 are interconnected to the stem pins 87 and 88, respectively. Fourth grid 46 is connected to a variable resistor 90 through an inner lead 86 and stem pin 92, while sixth grid 50 is interconnected to the anode terminal 26 via the shield cup 52, spring members 80 and anode 24. Variable resistor 90 has a value of 0-10 MΩ.

The structure mentioned above permits a high anode voltage, applied to sixth grid 50, to be divided and applied to the third, fourth and fifth grid electrodes 44, 46 and 48; that is, resistance glass portion 84 and variable resistor 90 connected to the fourth grid 46 produce the various voltages needed to operate the grids.

Figure 4:
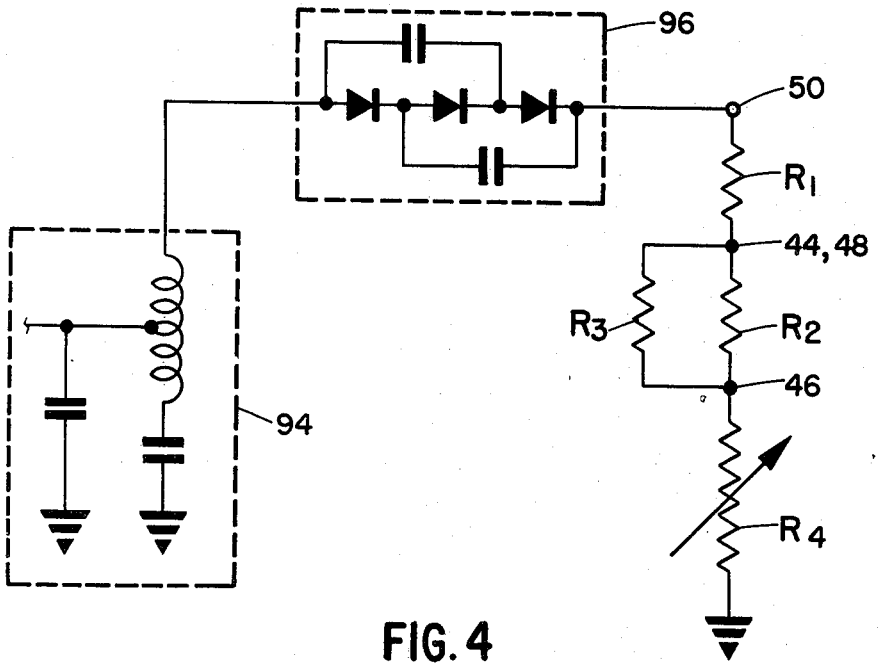
FIG. 4 is an equivalent circuit of the electron gun shown in FIG. 2.

In FIG. 4, an equivalent circuit is shown for the structure of FIG. 2. The high voltage generated from a flyback transformer 94 is rectified by a high voltage rectifier circuit 96 and supplied through anode terminal 26 to grid electrodes 50, 48, 44 and 46. The supplied current passes through resistance components $R_1$, $R_2$ and $R_3$ of the resistance glass portion 84 and a resistance $R_4$ of the variable resistor 90. Third and fifth grids 44 and 48 have an equi-potential due to inner lead 85; the resistance value between these grids and fourth grid 46 is obtained from the parallel connection of $R_2$ and $R_3$.

During normal operation, a 25 Kv anode voltage is applied to the sixth grid 50 through spring members 80 and shield cup 52 and upon adjusting the 10 MΩ resistor $R_4$, approximately 7 Kv is applied to the third and the fifth grids 44 and 48, and approximately 700 V is applied to the fourth grid 46. Moreover, approximately 500 V is applied to second grid 42 via the stem pin 88. Also, the first grid 40 is connected to zero potential and the cathodes 34, 36 and 38 are connected to approximately 150 V potential through stem pin 87. As a result, a sub-electrostatic lens is formed among the third, fourth and fifth grids 44, 46 and 48, while a main electrostatic lens is formed between the fifth and sixth grids 48, 50. Third and fifth grids 44, 48, are especially important in influencing the focusing of the electron beams.

Each of the resistance values between the grids is determined by the inherent resistance value of the resistance glass, the amount of contact area of the grid with the resistance glass, and the distance between the grids. Therefore, these parameters must be selected so that predetermined potentials are supplied to the grids from the high anode voltage. In this embodiment, for example, resistance glass portion 84 is made of a glass body having the inherent resistance value 500 MΩ. mm; the distance between the fifth and the sixth grids 48, 50 is 7.2 mm, while the respective distance between the fourth and the fifth grids 46, 48 and between the third and the fourth grids 44, 46 is 5.6 mm.

Figure 5A:
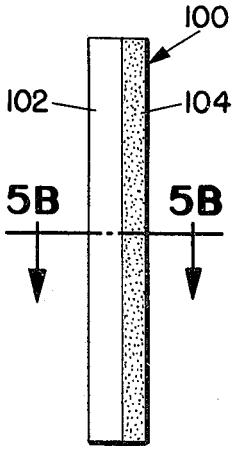
FIG. 5A is a side elevational view partially in section of the supporting rod of the invention.
Figure 5B:
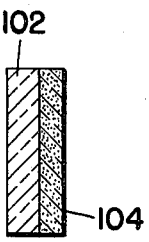
FIG. 5B is a sectional view of the supporting rod shown in FIG. 5A taken along line B—B.
Figure 7A:
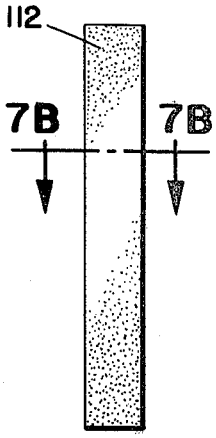
FIG. 7A is a side elevational view, partially in section, of a further supporting rod of the invention.
Figure 6A:
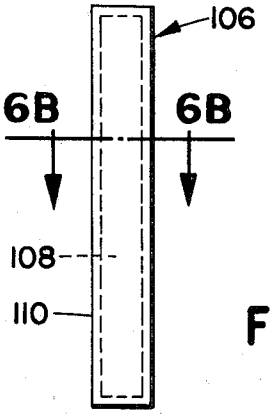
FIG. 6A is a side elevational view, partially in section, of another supporting rod of the invention.
Figure 6B:
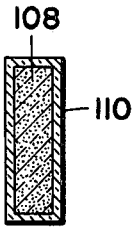
FIG. 6B is a sectional view of the supporting rod shown in FIG. 6A taken along line B—B.
Figure 7B:
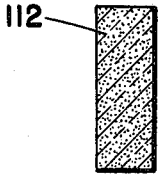
FIG. 7B is a sectional view of the supporting rod shown in FIG. 7A taken along line B—B.

Alternative structures for the supporting rods 56, 58 can be constructed as shown in FIGS. 5A and 5B, 6A and 6B and, 7A and 7B. A supporting rod 100, as shown in FIGS. 5A and 5B, comprises a combination of an insulating glass layer 102 and a resistance glass body layer 104. Each of these layers are fused together to form the integral supporting rod structure. Rod 106, as shown in FIGS. 6A and 6B, comprises a resistance glass body 108 wherein all of its surfaces are coated with an insulating glass layer 110. Rod 112, as shown in FIGS. 7A and 7B, comprises a single resistance glass body formed of a homogenous composition of insulating glass and resistance glass. A variety of the supporting rod structures can be freely formed according to the desired grid structure and operating voltages.

Another alternative arrangement of the embodiments mentioned above is shown in FIGS. 8 and 9, wherein parts identical and corresponding to FIGS. 1–4 are denoted with like reference numerals. Rather than the use of a variable resistor 90, a low voltage source 114 is connected to stem pin 92; this voltage is applied to fourth grid electrode 46 via inner lead 86. As a result, predetermined potentials are supplied to the third, fourth and fifth grid 44, 46, 48. Utilizing low voltage supplying source 114, the potentials divided by the resistance glass body can be more precisely controlled.

A further alternative arrangement of the embodiment mentioned above is shown in FIGS. 10 and 11, wherein parts identical and corresponding to FIGS. 1–4 are denoted with like reference numerals. Stem pin 92 is connected to a series connected variable resistor 90 and potentiometer 116. Potentiometer 116 has a movable tap 118 which is connected to a stem in 89. Stem pin 89 is connected to the second grid 42 through an inner lead 120. With this structure, the anode voltage applied to the sixth grid 50 is divided by the resistance glass body 84, the variable resistor 90 (i.e., resistance $R_4$) and the potentiometer 116 (i.e., resistance $R_5$); the divided voltages are supplied to the second grid 42, the third grid 44, the fourth grid 46, and the fifth grid 48.

As previously mentioned, the 7 Kv potential which is supplied to the third and fifth grids 44, 48 represents a divided potential of the anode voltage produced by the resistance glass body 84. Consequently, there is no need for supplying a high voltage to stem pin 92, in fact, at most only 700 V is supplied. Therefore, discharges between stem pins are avoided. Moreover, since the supporting rod itself acts as a resistor with a high power rating, there is no need to allocate additional space for installing separate resistor within the confines of the neck of the tube. Furthermore, the use of a resistance glass body prevents discharges from occuring caused by charge build-up of the supporting rod since the resistance glass body does not permit electron charges to be stored thereon.

Figure 8:
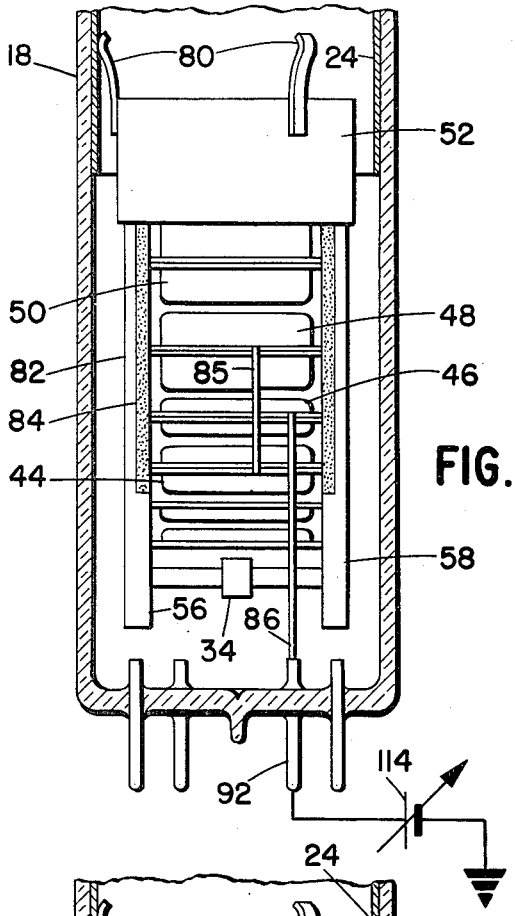
FIG. 8 is a side elevational view of another embodiment according to this invention.
Figure 9:
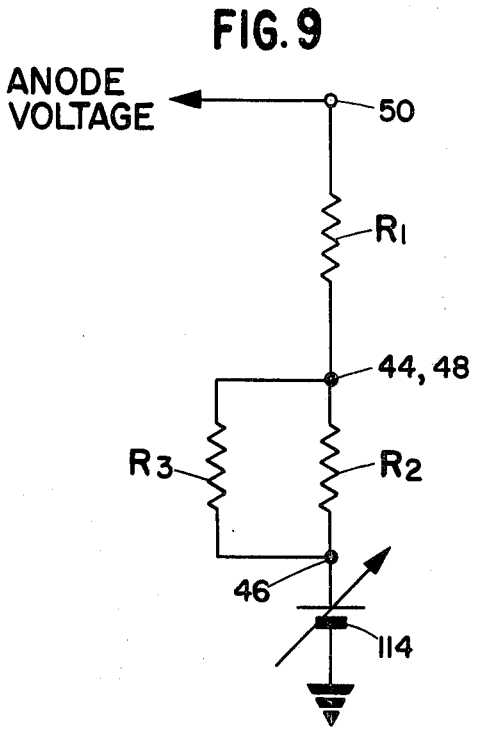
FIG. 9 is an equivalent circuit of the embodiment shown in FIG. 8.
Figure 10:
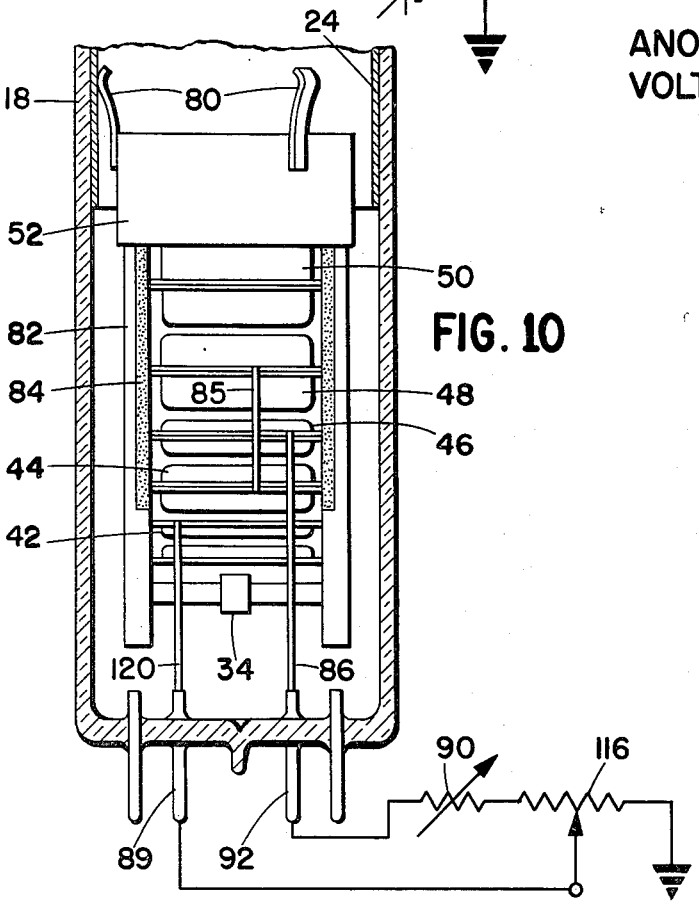
FIG. 10 is a side elevational view of a further embodiment according to this invention.
Figure 11:
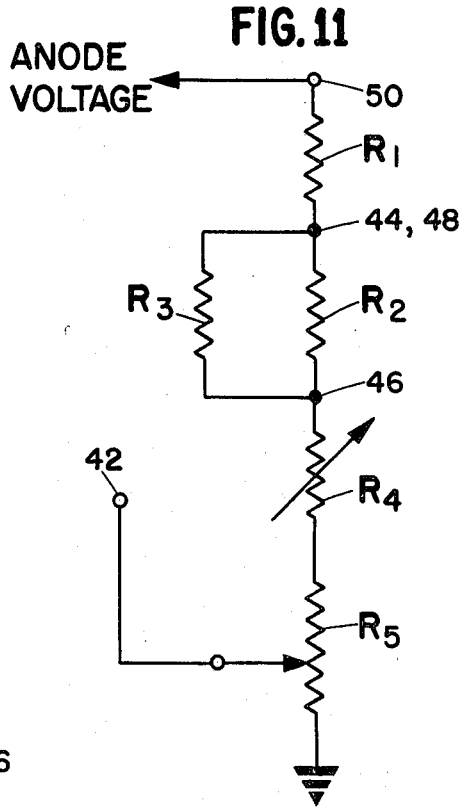
FIG. 11 is an equivalent circuit of the embodiment shown in FIG. 10.

Alternatively, the resistive value of the resistance glass body can be selected so that the potential of the fourth grid is at zero volts (i.e., ground potential) without the use of an outer source 114 as shown in FIGS. 8 and 9, or the use of resistor 90 and potentiometer 116 as shown in FIGS. 10 and 11. In that case, the potential supplied to second grid 42 can also be supplied from the resistance glass body.

Figure 12:
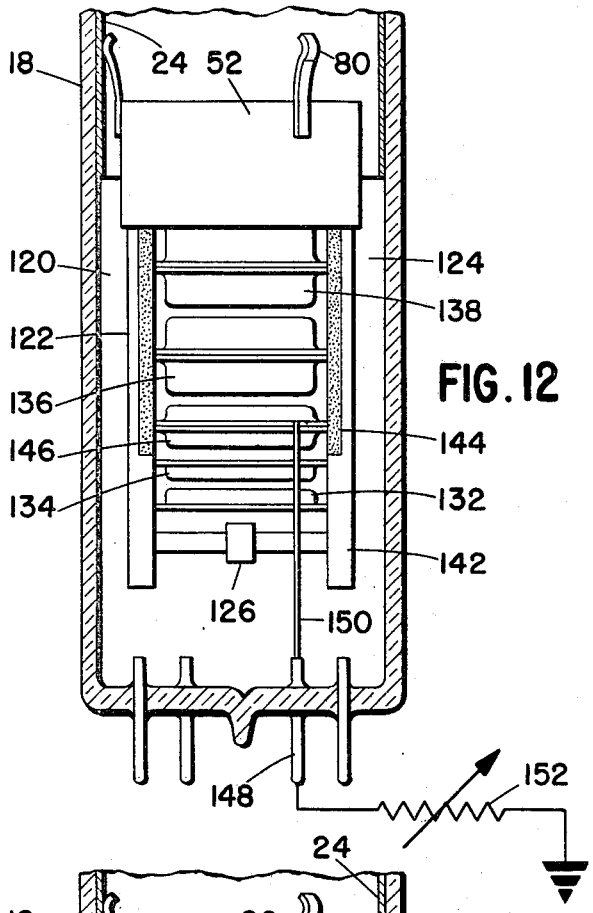
FIG. 12 is a side elevational view of a still further embodiment of this invention.
Figure 13:
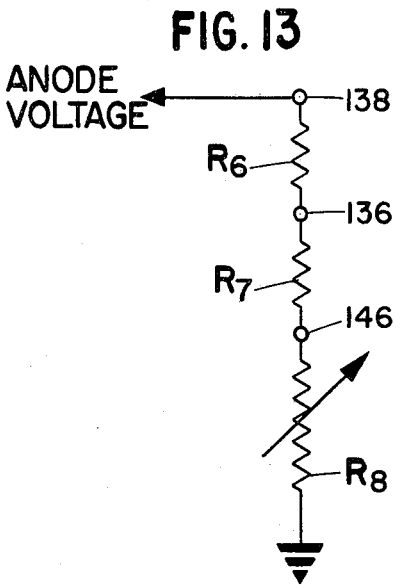
FIG. 13 is an equivalent circuit of the embodiment shown in FIG. 12.

Another embodiment of this invention is illustrated in FIGS. 12 and 13. As will be discussed, this embodiment discloses an electron gun utilizing four grid electrodes and a ring electrode. The electron gun structure 120 comprises a pair of supporting rods 122, 124, three cathodes 126 containing respective heaters (not shown), a first grid 132, a second grid 134, a third grid 136, a fourth grid 138 and a shield cup electrode 52. Electrodes 126–138 are securely supported by supporting rods 122, 124. As previously described, each of the supporting rods comprises an insulating glass body 142 and a resistance glass body 144, as shown in FIG. 4. Moreover, the support rods can have the alternative form shown in FIGS. 5–7. The third and fourth grids 136, 138 are mounted to the resistance glass body 144. Between the second and third grids 134, 136 a ring like electrode 146 is provided which is embedded in the rearmost ends of the resistance glass body 144. This ring-like electrode 146 is interconnected to a stem pin 148 through an inner lead 150; the other end of stem pin 148 is grounded through a variable resistor 152. Fourth grid 138 is connected to an anode 24 through shield cup 52 and spring members 80. Consequently, as shown in FIG. 13, resistance $R_6$ is formed across the fourth and the third grids 138, 136 and resistance $R_7$ is formed across third grid 136 and the ring-like electrode 146. The resistance $R_8$ is controlled by variable resistor 152. During operation, a high anode voltage is supplied to the fourth grid 138 and divided potentials are created at points along the resistance glass body which contact electrodes 136 and 146.

Figure 14:
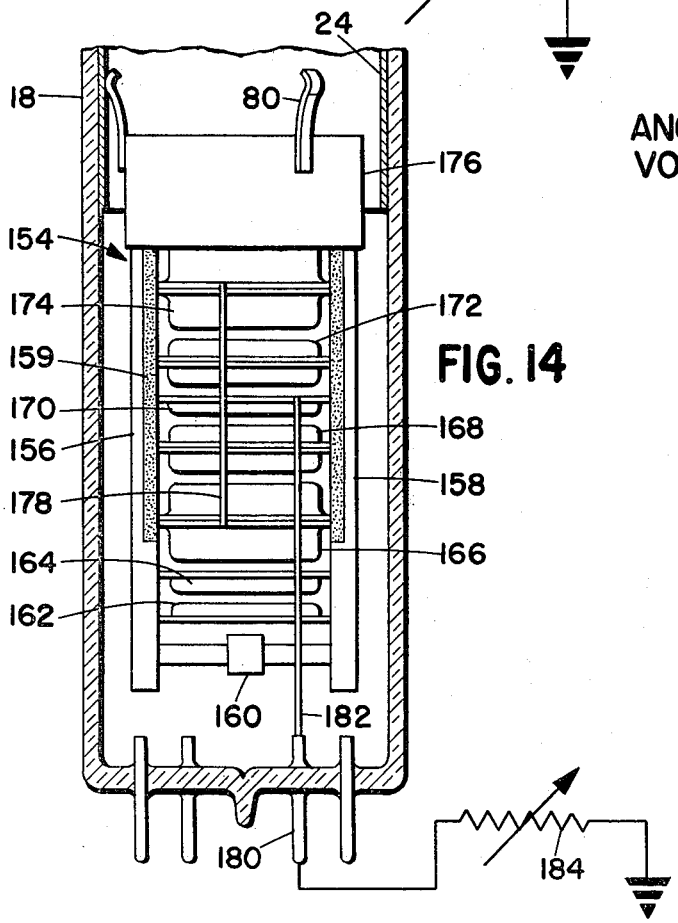
FIG. 14 is a side elevational view of a yet further embodiment of this invention.
Figure 15:
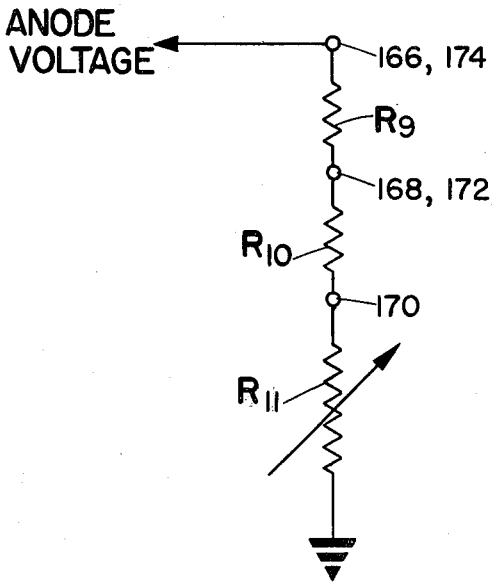
FIG. 15 is an equivalent circuit of the embodiment shown in FIG. 14.

A further embodiment of this invention is illustrated in FIGS. 14 and 15. As will be described, this embodiment discloses an electron gun utilizing seven grid electrodes. The electron gun 154 is provided with a pair of supporting rods 156 and 158. Each of supporting rods comprises an insulating glass body 159 having a lower resistance than insulating glass, as previously discussed with reference to FIG. 4. Moreover, the supporting rods can have the alternative form shown in FIGS. 5–7. As previously discussed, the resistance glass acts as a solid resistor utilizing bulk properties which provides a relatively large power rating.

The electron gun further comprises three cathodes 160, a first to seventh grids 162–174 and a shield cup 176, all arranged successively along the tube axis by means of supporting rods 156 and 158. The third to seventh grids 166–174 directly contact resistance glass body 159. Third grid 166 and seventh grid 174 are interconnected via inner lead 178, while fifth grid 170 and stem pin 180 are interconnected via inner lead 182. The other end of stem pin 180 is connected to a variable resistor 184 to ground. Seventh grid 174 is connected to the anode 24 through the shield cup 176 and spring members 80. The operating voltages for grids 162 and 164 are supplied through the stem pins.

As a result of these grid electrode connections, an equivalent circuit is formed as shown in FIG. 15. During operation, the high anode voltage is supplied to grid electrodes 166 and 174 and is divided by the resistance glass body. The potential divided by resistance $R_9$ and $R_{10}$ of the resistance glass body 159 is applied to the fourth and sixth grids 168 and 172. The variable resistor 184 has a resistance $R_{11}$ which provides a divided voltage to fifth grid electrode 170.

According to the invention, as mentioned above, since the relatively high anode voltage is divided by the supporting rod itself by its resistance glass portion, the following advantages are obtained: voltages are supplied to the grids without utilizing additional stem pins; the voltage difference among the stem pins and the number of stem pins are reduced; and the narrow neck portion of the tube can be maintained. As a result, the reliability of the picture tube will be increased.

We claim:

1. A picture tube device comprising:

an electron gun within an evacuated envelope comprising a cathode means for generating an electron beam, and a plurality of successively arranged electrodes for focusing and accelerating said electron beam, potential means for supplying potentials to said electrodes; and, at least one supporting means, coupled to said potential means, for securely supporting each of said electrodes, said supporting means comprising a solid homogenous resistance glass body and at least one of said electrodes being embedded in and in direct connection with said resistance glass body, whereby a potential is supplied directly to said one electrode through said resistance glass body.

2. The picture tube device of claim 1 wherein said one grid is secured and connected to an intermediate portion of said resistance glass body, said potential means supplying a potential across both ends of said resistance glass body, whereby an intermediate potential is produced in said resistance glass body and is supplied to said one grid.

3. The picture tube device of claims 1 or 2 wherein said insulating body comprises insulating glass.

4. The picture tube device of claims 1 or 2 wherein said resistance glass body is made of silica glass containing an oxide of a transition metal.

5. A picture tube device comprising:

an evacuated envelope comprising a panel, a funnel portion extending from said panel, and a neck portion extending from said funnel portion and terminating in a stem portion;

an anode disposed on an inner wall of said funnel portion, an anode terminal positioned on said funnel portion, and a plurality of stem pins disposed on said stem portion;

an electrode gun positioned within said neck portion, said electron gun comprising a cathode generating an electron beam and a plurality of grids for focusing and accelerating said electron beam, and potential means for supplying potentials to said anode through said anode terminal and to said cathode and grids through at least one of said stem pins; and, at least one glass supporting means for securely supporting said cathode and grids, said glass supporting means comprising a solid homogenous resistance glass body and at least one of said grids being embedded in and in direct connection with said resistance glass body, said resistance glass body being coupled to said anode and to another of said stem pins, whereby a potential is divided by said resistance glass body and is supplied directly to said one grid.

6. The picture tube of claim 5 wherein said resistance glass body is connected to a variable resistor through said other stem pin.

7. The picture tube of claim 5 wherein said resistance glass body is connected to a low voltage source through said other stem pin.

* * * * *